US005996780A

United States Patent [19]

Gurrera

[11] Patent Number: 5,996,780

[45] Date of Patent: Dec. 7, 1999

[54] COSMETIC APPARATUS

[76] Inventor: Vivien K. Gurrera, 454 Grasmere La., Aberdeen, Md. 21001

[21] Appl. No.: 08/954,500

[22] Filed: Oct. 20, 1997

[51] Int. Cl.[6] ..... B65D 75/28

[52] U.S. Cl. ..... 206/209; 206/210

[58] Field of Search ..... 206/209, 210, 206/229, 440, 526, 581, 209.1; 424/364

[56] References Cited

U.S. PATENT DOCUMENTS

| | | | |
|---|---|---|---|
| 1,146,522 | 7/1915 | Robert . | |
| 1,573,648 | 2/1926 | Sheely . | |
| 1,652,108 | 12/1927 | Forbis . | |
| 2,579,403 | 12/1951 | Slomowitz et al. | 128/268 |
| 3,078,856 | 2/1963 | Bender et al. | 132/93 |
| 3,103,682 | 9/1963 | Markle | 15/244 |
| 3,163,160 | 12/1964 | Cohen | 128/2 |
| 3,343,540 | 9/1967 | Siegel | 128/269 |
| 3,513,830 | 5/1970 | Kalayjian | 128/2 |
| 3,640,268 | 2/1972 | Davis | 128/2 B |
| 4,192,300 | 3/1980 | Devers | 128/155 |
| 4,194,290 | 3/1980 | Vallhonrat | 433/141 |
| 4,324,802 | 4/1982 | Koulbanis et al. | 424/364 |
| 4,611,611 | 9/1986 | Beal, Jr. | 132/88.7 |
| 4,635,795 | 1/1987 | DeFlander et al. | 206/526 |
| 4,747,719 | 5/1988 | Parkin | 401/132 |
| 4,795,421 | 1/1989 | Blasius, Jr. et al. | 604/1 |
| 4,887,994 | 12/1989 | Bedford | 604/1 |
| 4,896,768 | 1/1990 | Anderson | 206/210 |
| 4,952,204 | 8/1990 | Korteweg | 604/1 |
| 5,368,581 | 11/1994 | Smith et al. | 206/210 |
| 5,378,226 | 1/1995 | Hanifl et al. | 604/3 |
| 5,445,454 | 8/1995 | Barkhorn | 206/440 |

*Primary Examiner*—Jim Foster

[57] ABSTRACT

A cotton or foam swab (or other applicator) is individually wrapped in a sterilized plastic-lined aluminum foil package having a tear-open tab or strip, and the swab has a tip portion which is saturated with a combination of an anti-aging cream and an eye/face make-up remover.

1 Claim, 7 Drawing Sheets

COSMETIC APPARATUS

FIELD OF THE INVENTION

The present invention relates to an improved dual-purpose device and method which facilitates the removal of eye or face make-up and simultaneously applies an anti-aging cream for time-savings and convenience.

BACKGROUND OF THE INVENTION

In the prior art, various creams, gels and other cosmetics (and cosmetic removers) have been packaged in jars, tubes and other containers; and the user is required to open the container, dip a cotton swab, tissue or other applicator (or perhaps even one's finger) into the container to absorb some of the cosmetic, and then apply that cosmetic to the eyes or other facial areas.

For example, one jar may contain an eye or face make-up remover, while another (completely separate) jar may contain an anti-aging cream.

Typically, only a portion of the cosmetics (or cosmetic removers) is used over a given period of time, and the user eventually discards the jars containing the remainder of the cosmetics (or cosmetic removers).

Besides, it is not convenient to carry several jars in one's purse or while traveling; and even in the home, it is not at all unlikely that the same make-up remover (for example) will be found in the bedroom and in the bathroom.

There is also the problem of a possible infection. Bacteria will grow in the jar, especially when the jar is left open and its contents exposed during application of the cosmetic; and the infection may be spread from one user to another. Moreover, and because of the bacteria, in the removal of eye shadow and eyelash make-up, the eyes may become reddened and cause tears to flow. In other instances, a skin rash may develop, or else an existing acne condition may become aggravated.

Cotton swabs, of course, have been known for many years for medical, personal hygiene and cosmetic purposes. A well-known brand is Q-TIPS® cotton swabs manufactured and sold by Cheseborough Ponds USA Company. These cotton swabs consist of a somewhat flexible stem having a cotton (or foam) ball or tip at each end of the stem, and a quantity of such swabs is packaged in a container, such as a box provided with a lid at one end thereof.

It will be appreciated, of course, that once the box has been opened and an individual cotton swab removed, that the sterility of the cotton swabs remaining in the box has become compromised.

The prior art has also disclosed medicated applicators on cotton swabs. For example, in U.S. Pat. No. 1,652,108 issued to Forbis in 1927, the end or ends of the stem are dipped into a liquid antiseptic solution during the manufacturing process; and then the stem which is still moist is pressed into a mass of porous materials with a twisting motion, thereby producing a cotton swab provided with an antiseptic.

From this early disclosure, it is seen that medicated cotton swabs are at least seventy years old.

On the other hand, and from an entirely different technological perspective, surgical scalpel blades have long been individually packaged in an aluminum foil; the ends of the foil package are suitably crimped, and the package with the blade is then radiation sterilized. However, despite this recognized technology, albeit for an entirely different product line, no one (prior to the present invention) has ever combined these existing technologies for a synergistic result.

Indeed, the prior art, is exemplified by the U.S. Pat. No. 4,952,204 issued to Korteweg in 1990 resorted to a plastic sleeve. This plastic sleeve had a relatively small-diameter cylindrical handle portion closely housing the stem in the swab, and this plastic sleeve further had a relatively large-diameter receptacle portion surrounding the tip on the end of the stem.

Nor is an anti-aging cream combined directly with an eye/face make-up remover and made readily and conveniently available in a sterile individually-wrapped swab or other applicator.

SUMMARY OF THE INVENTION

Accordingly, it is an object of the present invention to provide an individually-wrapped swab (or other applicator) saturated with a combination eye/face makeup remover and an anti-aging cream, thereby completely obsoleting the existing practice of dipping a tissue, a cotton or foam swab (or other applicator) or even one's finger into half-used jars containing these respective cosmetics.

This invention thus serves the dual purpose of removing eye/face make-up and applying antiaging cream simultaneously and conveniently, and the combination eye/face makeup remover and anti-aging cream is maintained fresh and hygienically sterile.

The swab is preferably sealed within a tear-open aluminum foil package having a tear tab, so that the swab may be quickly removed from the package; and, preferably, the package is radiation sterilized.

In a preferred embodiment, the tip on the swab is saturated with a combination anti-aging cream and eye/face make-up remover.

Preferably, a pair of plastic strips are disposed within the tear-open aluminum foil package, one on each side of the applicator on the swab.

The plurality of tear-open packages is preferably contained in a box provided with a lid.

Viewed in another aspect, the present invention provides an improved and convenient method of simultaneously applying an anti-aging cream combined with an eye/face make-up remover. A tear-open package containing a swab is provided, and the swab includes a stem having a pair of ends and further having a tip on at least one end of the stem. This tip is saturated with a combined anti-aging cream and eye/face make-up remover. The package is torn open, and the stem is grasped to apply the tip, the tip being saturated with the combination anti-aging cream and eye/face make-up remover.

These and other objects of the present invention will become apparent from a reading of the following specification taken in conjunction with the enclosed drawings.

DESCRIPTION OF THE PREFERRED EMBODIMENTS

Figure 1:
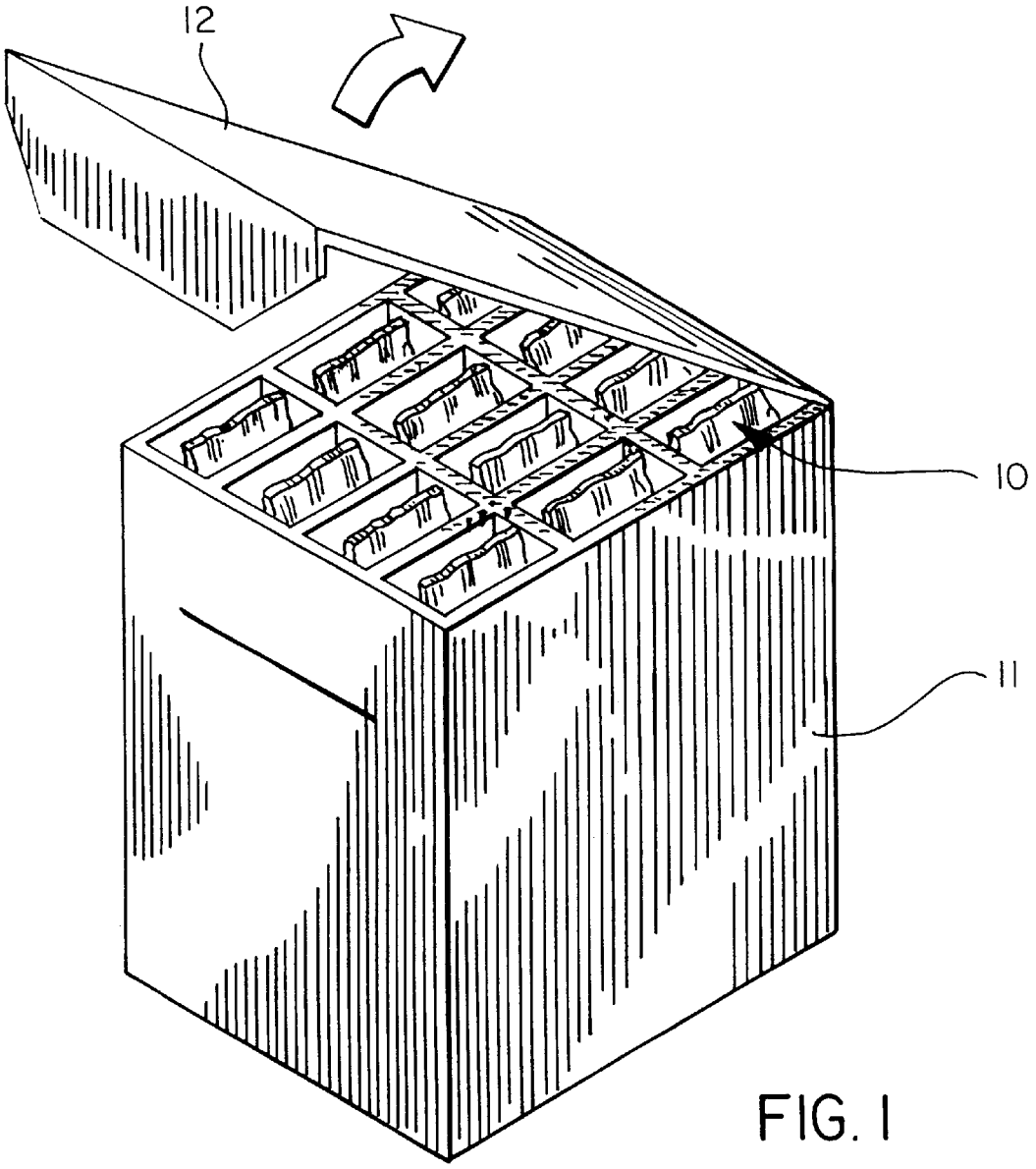
FIG. 1 is a perspective view of a box (or other suitable container) for a plurality of individually-wrapped swabs.
Figure 2:
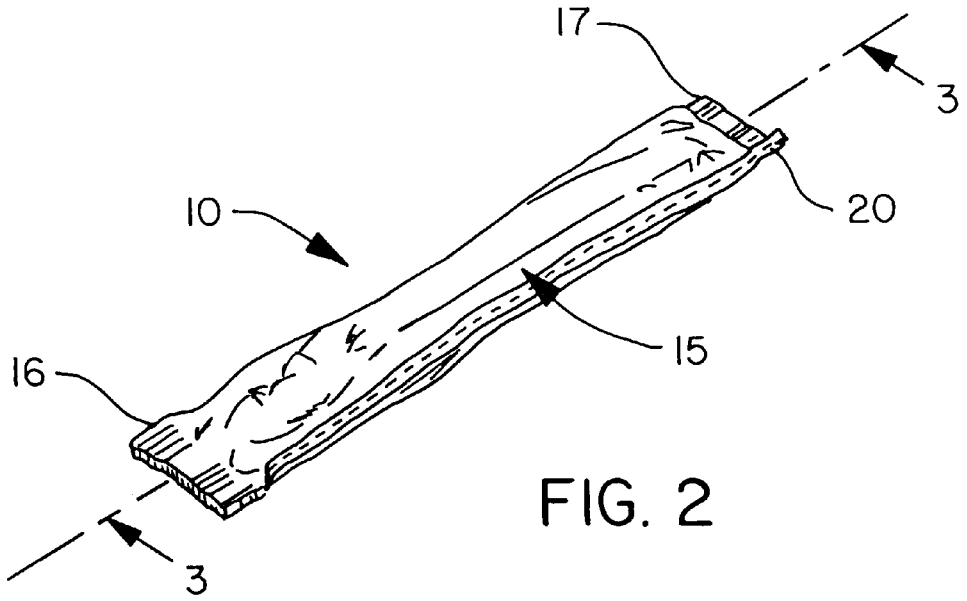
FIG. 2 is a perspective view of one of the individually-wrapped swabs removed from the box.

With reference to FIGS. 1 and 2, a plurality of individually-wrapped applicators, such as swabs 10, are contained within a box 11 having a lid 12. It will be appreciated by those skilled in the art that the individually-wrapped swabs 10 may be housed in any suitable container, if desired, or else sold or dispensed individually.

Figure 3:
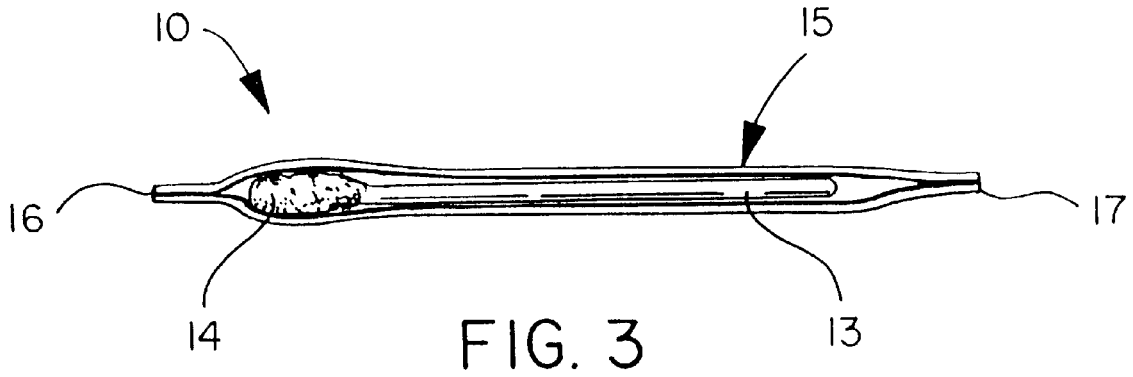
FIG. 3 is a longitudinal section of the individually-wrapped swab, taken along the lines 3—3 of FIG. 2.
Figure 4:
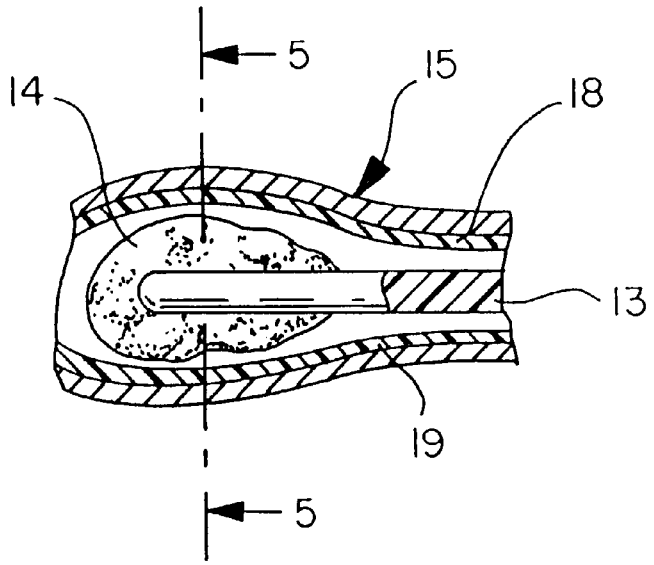
FIG. 4 is an enlarged portion of FIG. 3, showing the swab wrapped in an aluminum foil package.
Figure 5:
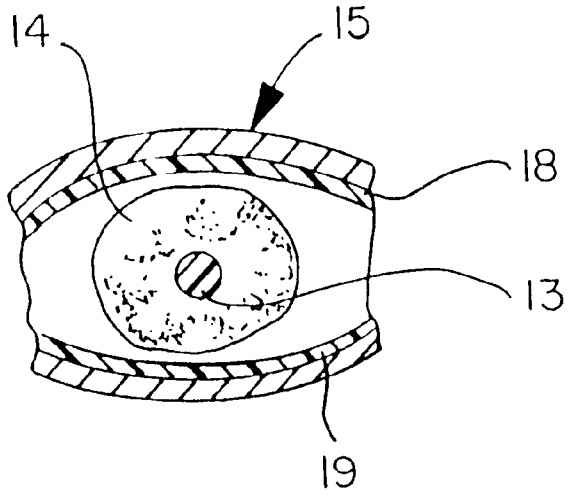
FIG. 5 is a cross-section thereof, taken along the lines 5—5 of FIG. 4.

With this in mind, and with further reference to FIGS. 3–5, the swab 10 has a stem 13 and a tip 14 mounted on the end of the stem 13. The stem 13 may be made of wood or else of plastic to accommodate some flexibility or bending of the stem 13 during use of the swab 10.

The swab 10 is tightly contained within an aluminum foil package 15, the ends 16 and 17 of which are crimped (as shown more clearly in FIGS. 2 and 3). Preferably, a pair of plastic strips 18 and 19, respectively, are disposed between the swab 10 and the aluminum foil package 15; and the package 15 has a tear tab 20.

Figure 6:
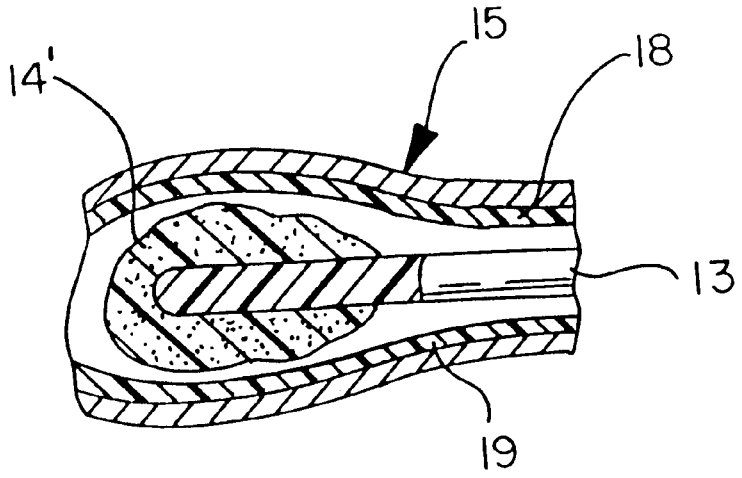
FIG. 6 corresponds to FIG. 4, but shows a foam plastic swab instead of the cotton swab of FIG. 4.

The tip 14 on the swab 10 may be of cotton (as shown in FIG. 4) or of foam plastic as shown at 14' in FIG. 6.

Preferably, the aluminum foil package 15 for the individual swab 10 is radiation sterilized.

Figure 8:
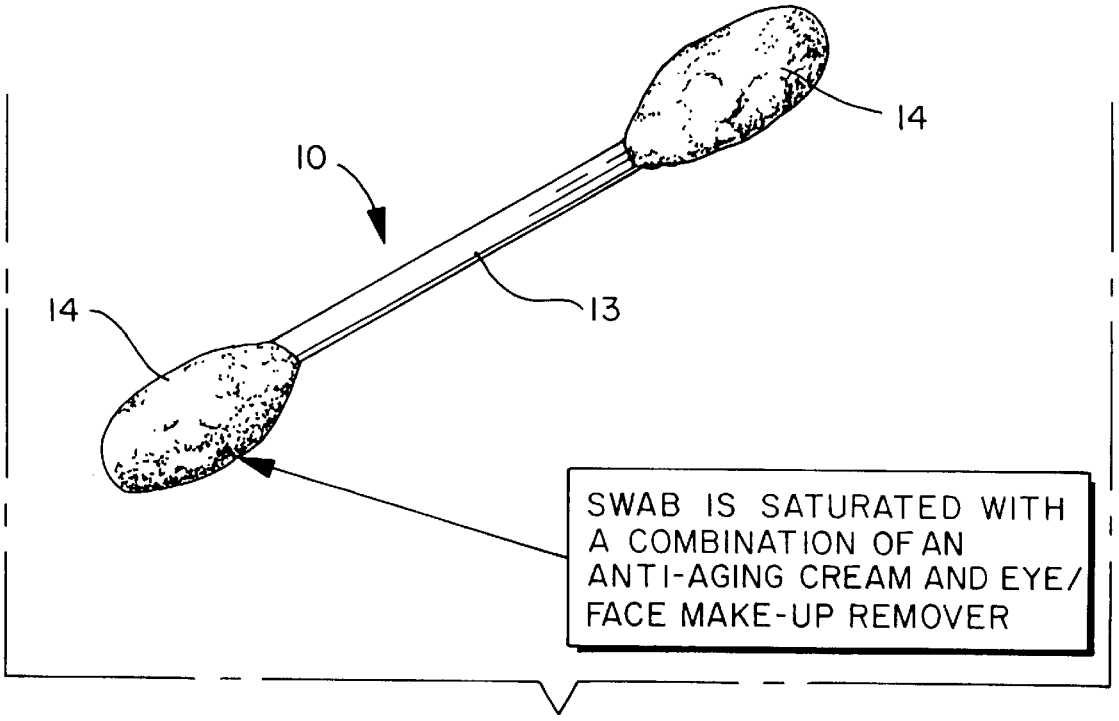
FIG. 8 is a schematic view, illustrating that the preferred swab (of either FIG. 4 or FIG. 6) is saturated with a combination anti-aging cream and make-up remover. Also, the swab 10 is double-ended and has tips 14 at each end thereof.
Figure 9:
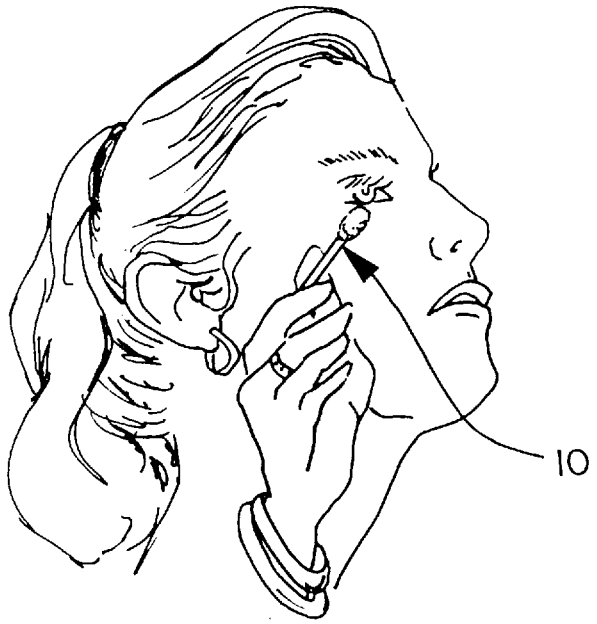
FIG. 9 is a pictorial view, showing the typical use of the preferred embodiment of the swab of the present invention.

In accordance with the further teachings of the present invention and as illustrated in FIG. 8, both tips 14 on the swab 10 are saturated with a combination anti-aging cream and eye/face make-up remover.

Figure 7:
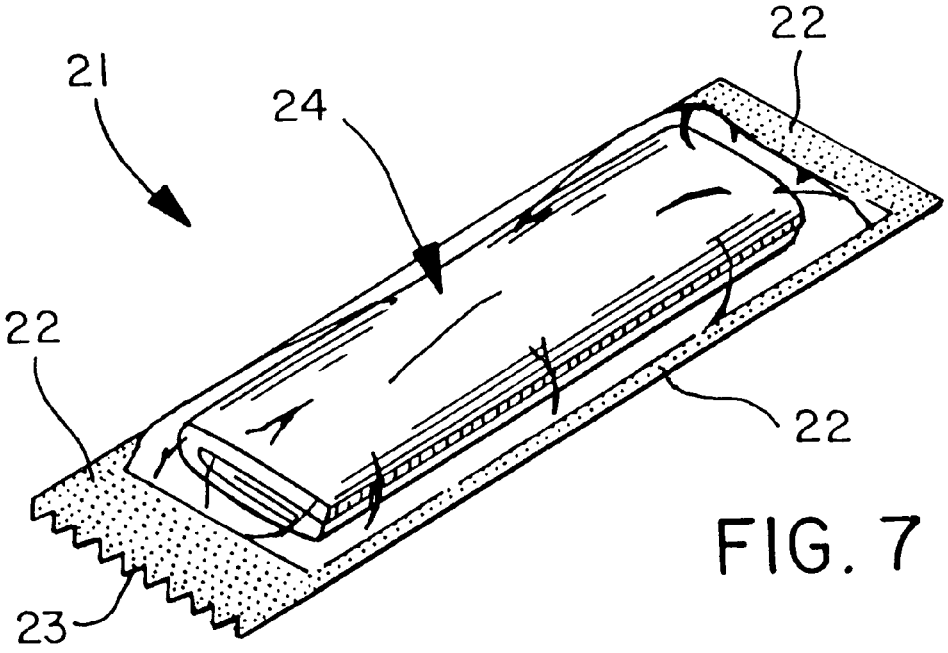
FIG. 7 shows another applicator of the present invention, constituting a towelette, packaged in a heat-sealed transparent plastic sleeve.

With reference to FIG. 7, an alternate embodiment of the present invention is illustrated, constituting a transparent plastic pouch or sleeve 21. This sleeve 21 has heat-sealed edges 22 and a tear strip 23 at one end thereof. An applicator comprising a towelette 24 is contained within the sleeve 21, and the towelette 24 is saturated with the combination anti-aging cream and eye/face make-up remover. The sleeve 21 may also be sterilized by radiation or by gas (such as ethylene oxide).

Figure 10:
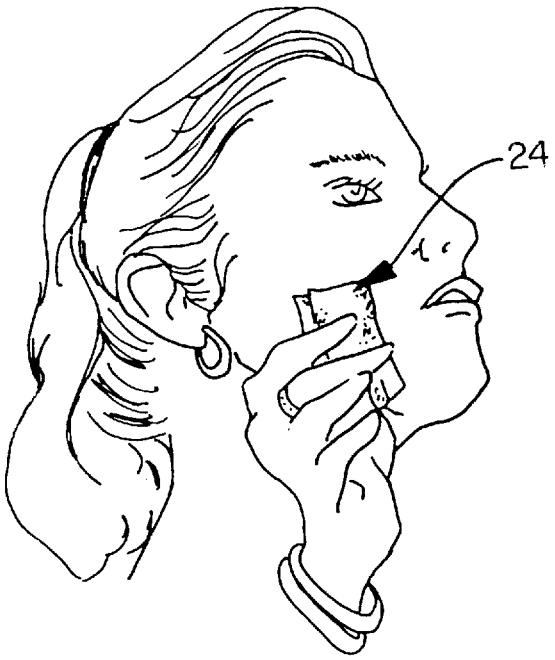
FIG. 10 is a further pictorial view, showing the use of the towelette of FIG. 7.

The use of the towelette 24 is illustrated in FIG. 10.

As a result of this invention, a number of features and advantages (heretofore not available in the prior art) have been provided, as follows:

1) A "fresh" (and preferably sterilized) swab 10 or towelette 24 is used and then discarded.
2) It is no longer necessary to store half-used jars or tubes of a caked-up anti-aging cream and a separate eye/face make-up remover in the bedroom or bathroom of the home. Indeed, the eye/face make-up remover is combined directly with the anti-aging cream in a convenient applicator (swab 10 or towelette 24).
3) Nor is it necessary to carry these half-used jars or tubes in one's purse or in one's travel bag; and in lieu thereof, a small box 10 may be carried, or else individual swabs 10 (or towelettes 24) may be carried in one's purse or pocket or even made available in a vending machine.
4) The combination anti-aging cream and eye/face make-up remover does not become stale, nor subject to bacteria; and there is no risk of an eye irritant, rash or infection.
5) The individually-wrapped swabs 10 (or towelettes 24) have quick tear-open tabs 20 (or a tear-open strip 23) so that the swab 10 (or towelettes 24) may be used easily and conveniently and then discarded.
6) The individual swabs 10 (or towelettes 24) may be produced economically and in high volume, using readily available manufacturing methods, and then marketed through various channels of merchandising and distribution for widespread usage.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A tear-open foil package for a swab saturated with a combination anti-aging cream and eye/face make-up remover or the like, comprising a swab individually wrapped within a sterilized aluminum foil tear-open package that tightly grips the swab, the swab having a stem and further having an end provided with a tip, the tip being saturated with a combination anti-aging cream and eye/face make-up remover, and a pair of plastic strips in the package, one on each side of the applicator on the swab.

* * * * *